US010655077B2

(12) United States Patent
Aldous et al.

(10) Patent No.: US 10,655,077 B2
(45) Date of Patent: May 19, 2020

(54) FORMING ASPHALT FRACTIONS FROM THREE-PRODUCT DEASPHALTING

(71) Applicant: ExxonMobil Research and Engineering Company, Annandale, NJ (US)

(72) Inventors: Keith K. Aldous, Montgomery, TX (US); Kamal Boussad, Bois Guillaume (FR); Kendall S. Fruchey, Humble, TX (US); Sara K. Green, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 16/031,288

(22) Filed: Jul. 10, 2018

(65) Prior Publication Data

US 2019/0016965 A1 Jan. 17, 2019

Related U.S. Application Data

(60) Provisional application No. 62/532,430, filed on Jul. 14, 2017.

(51) Int. Cl.

| | |
|---|---|
| ***C10G 67/04*** | (2006.01) |
| ***C10G 69/04*** | (2006.01) |
| ***C10G 55/06*** | (2006.01) |

(52) U.S. Cl.

CPC ..... *C10G 67/0454* (2013.01); *C10G 55/06* (2013.01); *C10G 69/04* (2013.01)

(58) Field of Classification Search

CPC ..... C10G 55/06; C10G 67/0454; C10G 69/04

See application file for complete search history.

(56) References Cited

U.S. PATENT DOCUMENTS

| | | | | |
|---|---|---|---|---|
| 3,919,072 | A * | 11/1975 | Pitchford | C08F 240/00 208/4 |
| 9,296,959 | B2 | 3/2016 | Gillis | |
| 2008/0149534 | A1 | 6/2008 | Gauthier et al. | |
| 2017/0029719 | A1 | 2/2017 | Merdrignac et al. | |

OTHER PUBLICATIONS

International Search Report and Written Opinion PCT/US2018/041409 dated Oct. 8, 2018.

* cited by examiner

*Primary Examiner* — Brian A McCaig

(74) *Attorney, Agent, or Firm* — Robert A. Migliorini; Scott F. Yarnell

(57) ABSTRACT

Systems and methods are provided for using a three-product deasphalter to produce advantageous combinations of deasphalted oil, resin, and rock. The desaphalted oil, resin, and rock can then be further combined, optionally with other vacuum gas oil fractions produced during the distillation that generated the feed to the three-product deasphalter, to produce a product slate of improved quality while also maintaining the quality of the resulting asphalt product and reducing or minimizing the amount of lower value products generated. The additional "resin" product from the three product deasphalter can be generated by sequential deasphalting, by using a resin settler to separate resin from the deasphalted oil, or by any other convenient method.

22 Claims, 3 Drawing Sheets

FORMING ASPHALT FRACTIONS FROM THREE-PRODUCT DEASPHALTING

CROSS-REFERENCE TO RELATED APPLICATIONS

This application claims the benefit of U.S. Provisional Application No. 62/532,430, filed on Jul. 14, 2017, the entire contents of which are incorporated herein by reference.

FIELD

Systems and methods are provided for production of asphalt and fuel products from deasphalter rock and deasphalter resin.

BACKGROUND

Conventionally, crude oils are often described as being composed of a variety of boiling ranges. Lower boiling range compounds in a crude oil correspond to naphtha or kerosene fuels. Intermediate boiling range distillate compounds can be used as diesel fuel or as lubricant base stocks. If any higher boiling range compounds are present in a crude oil, such compounds are considered as residual or "resid" compounds, corresponding to the portion of a crude oil that is left over after performing atmospheric and/or vacuum distillation on the crude oil.

Solvent deasphalting is a commonly used refinery process for processing of challenged and/or heavy oil feeds, such as resid fractions produced after distillation of a crude oil. Conventional solvent deasphalting configurations can be used to convert a heavy oil feed into a deasphalted oil fraction and a deasphalter residue or "rock" fraction. Unfortunately, achieving desired product qualities for both the deasphalted oil and the rock can pose difficulties. One of the main goals of solvent deasphalting can be to upgrade a challenged fraction, such as a vacuum resid, to a deasphalted oil. The deasphalted oil can then be suitable for processing to form, for example, lubricant base oils or distillate fuels. However, performing solvent deasphalting to form an upgraded deasphalted oil can tend to result in formation of a rock fraction that is not compatible for blending with vacuum gas oils. This incompatibility can pose challenges for finding a high value end use for the resulting rock fraction.

Some configurations for performing deasphalting to form three deasphalting products are also known. The third product typically corresponds to a product with intermediate quality relative to deasphalted oil and rock. This intermediate product can be referred to as a resin product.

U.S. Pat. No. 9,296,959 and U.S. Patent Application Publication 2013/0026063 describe configurations for performing solvent deasphalting to form a deasphalted oil product, a resin product, and a pitch product. The resin product is formed by passing the deasphalted oil through a resin settler. The deasphalting solvent is then separately removed from the resin product and the deasphalted oil product. The formation of the additional resin product is described as being beneficial for reducing the severity required for hydroprocessing of the deasphalted oil product and/or for reducing the amount of coke formed during further processing of the pitch product.

It would be beneficial to identify additional strategies for processing of challenged fractions that can allow for increased production of higher value products while maintaining desired product qualities for the resulting products.

SUMMARY

In various aspects, methods for processing a heavy oil fraction are provided. The methods include separating a vacuum gas oil fraction and a vacuum resid fraction from a heavy oil feed. Solvent deasphalting is then performed on at least a portion of the vacuum resid fraction under first solvent deasphalting conditions on at least a portion of the vacuum resid fraction to produce a first deasphalted oil and a first deasphalter residue. In some aspects, the first solvent deasphalting conditions can correspond to higher lift deasphalting conditions, where the effective solvent deasphalting conditions produce a yield of first deasphalted oil of 50 wt % or more of the feedstock. In other aspects, the first solvent deasphalting conditions can correspond to lower lift deasphalting conditions. A second solvent deasphalting process is then performed under second solvent deasphalting conditions. If the second solvent deasphalting conditions are lower lift than the first solvent deasphalting conditions, the second solvent deasphalting is performed on the first deasphalted oil. If the second solvent deasphalting conditions are higher lift than the first solvent deasphalting conditions, the second solvent desaphalting is performed on the first deasphalter residue. The changes in lift between the first deasphalting conditions and second deasphalting conditions can be achieved in any convenient manner, such as by changing the nature of the solvent or changing the temperature during deasphalting. A product slate can then be formed. If the second solvent desaphalting conditions are lower lift than the first solvent deasphalting conditions, the product slate can be formed from at least a portion of a) the vacuum gas oil fraction, b) the first deasphalter residue, c) the second deasphalted oil, and d) the second deasphalter resin. If the second solvent desaphalting conditions are higher lift than the first solvent deasphalting conditions, the product slate can be formed from at least a portion of a) the vacuum gas oil fraction, b) the second deasphalter residue, c) the first deasphalted oil, and d) the second deasphalter resin. The product slate can include an asphalt fraction and one or more fuels feeds, lubricant feeds, or a combination thereof. A volume of the product slate can correspond to 95 vol % or more of a combined volume of the vacuum gas oil fraction and the vacuum resid fraction, or 98 vol % or more, and/or 105 vol % or less, or 102 vol % or less. Further processing can then be performed on the one or more fuels feeds, lubricant feeds, or a combination thereof, the further processing comprising hydroprocessing, fluid catalytic cracking, or a combination thereof. The asphalt fraction can be incorporated into an asphalt product, optionally after air blowing. The asphalt fraction can optionally but preferably be incorporated into the asphalt product without exposing the asphalt fraction to thermal cracking conditions.

In such aspects, using a three-product deasphalter to perform a separation can allow for an increase in the amount of products in the product slate that are suitable for use either as a feed for distillate fuels and/or lubricants production, or for use in an asphalt product. Thus, the amount of fuel oil and/or rock fractions not suitable for incorporation into asphalt can be reduced or minimized.

In some aspects, the vacuum gas oil fraction can have a T10 distillation point of 482° C. or higher, or 510° C. or higher. In some aspects, the one or more fuels feeds, lubricant feeds, or a combination thereof can include a Conradson Carbon content of 10 wt % or less, or 8.0 wt % or less, or 6.0 wt % or less. In some aspects, the one or more fuels feeds, lubricant feeds, or a combination thereof comprise an API Gravity of 14 or more, or 16 or more.

In some aspects, the asphalt fraction can include at least a portion of the second deasphalter resin. In such aspects, the method can further include air blowing the asphalt fraction.

In various aspects, an asphalt composition is also provided. The asphalt composition can be formed by air blowing of an asphalt fraction, the asphalt fraction including a deasphalter resin having a kinematic viscosity at 100° C. of 5000 cSt or more.

DETAILED DESCRIPTION

Figure 1:
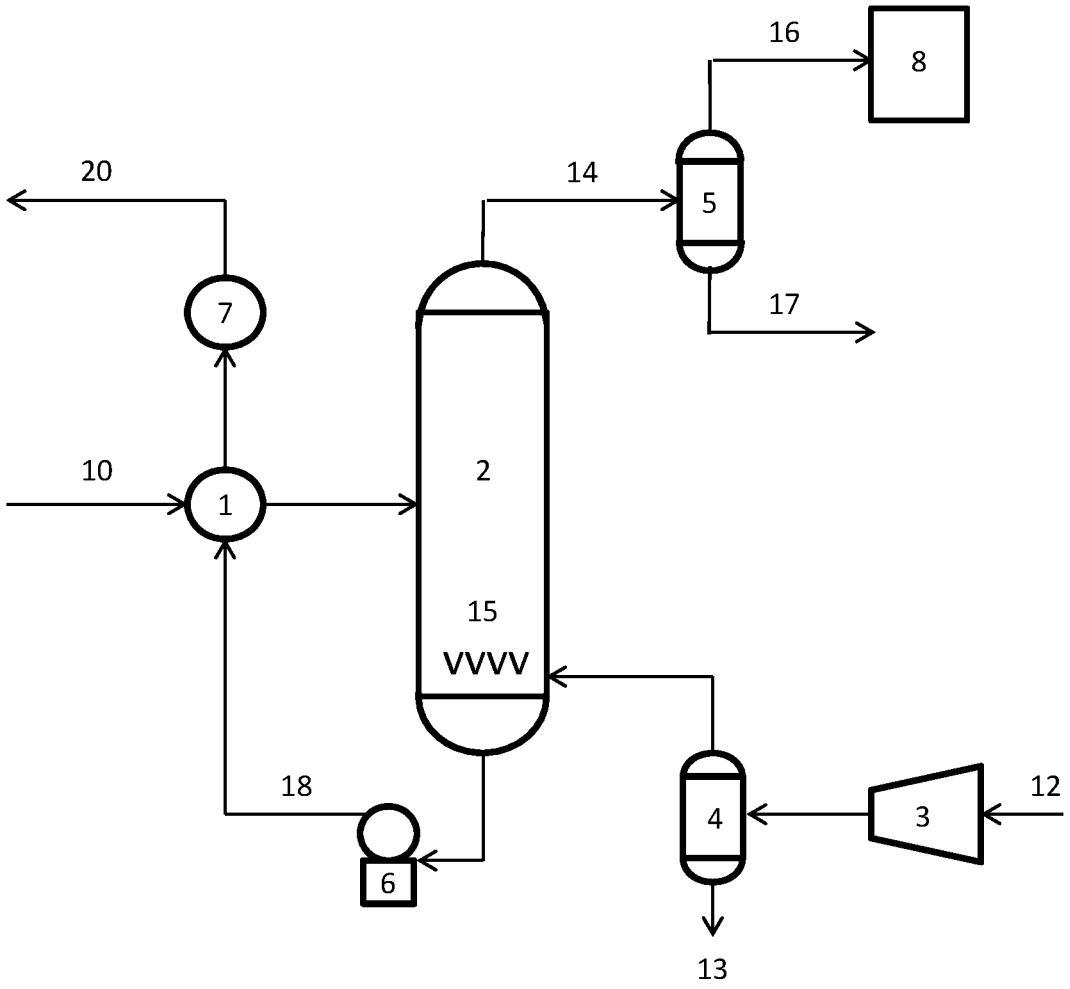
FIG. 1 hereof is a process flow scheme of an asphalt oxidation process.

All numerical values within the detailed description and the claims herein are modified by "about" or "approximately" the indicated value, and take into account experimental error and variations that would be expected by a person having ordinary skill in the art.

Overview

In various aspects, systems and methods are provided for using a three-product deasphalter to produce advantageous combinations of deasphalted oil, resin, and rock. The desaphalted oil, resin, and rock can then be further combined, optionally with other vacuum gas oil fractions produced during the distillation that generated the feed to the three-product deasphalter, to produce a product slate of improved quality while also maintaining the quality of the resulting asphalt product and reducing or minimizing the amount of lower value products generated. The additional "resin" product from the three product deasphalter can be generated by sequential deasphalting, by using a resin settler to separate resin from the deasphalted oil, or by any other convenient method.

Additionally or alternately, a three-product deasphalter can be used to generate a heavy resin product, such as a resin product with a kinematic viscosity at 100° C. of roughly 5000 cSt or more. The heavy resin product can be combined with vacuum gas oil and/or deasphalted oil and used to form a commercial grade asphalt after air blowing. Optionally, vacuum resid and/or rock can also be combined with the heavy resin for formation of the commercial grade asphalt.

As an example of sequential deasphalting, a deasphalting process can be performed to form a first deasphalted oil and rock. The first deasphalted oil can then be exposed to a second deasphalting process under deasphalting conditions that correspond to "lower lift" deasphalting conditions than the first deasphalting conditions. This can result in a second deasphalted oil and a residual fraction that corresponds to a resin fraction. The resin fraction can represent a fraction that traditionally would have been included as part of a deasphalter rock fraction (i.e., if a single deasphalting stage had been used with the lower lift conditions). However, because sequential deasphalting was performed, the resin fraction is available as a separate fraction that can be blended and/or further processed to form higher value products. In some aspects, the yield of the second deasphalted oil can have an overall yield relative to the initial feed that is similar to the yield for a single stage deasphalting process at the lower lift deasphalting conditions. As an example of sequential deasphalting, the first deasphalting process can correspond to hexane deasphalting while the second deasphalting process can correspond to pentane deasphalting. As another example, the first deasphalting process can correspond to pentane deasphalting while the second deasphalting process can correspond to propane deasphalting. In some aspects, the first deasphalting stage during sequential deasphalting can include deasphalting conditions that product a yield (i.e., lift) of deasphalted oil of 50 wt % or more, or 60 wt % or more, or 70 wt % or more.

Figure 3:
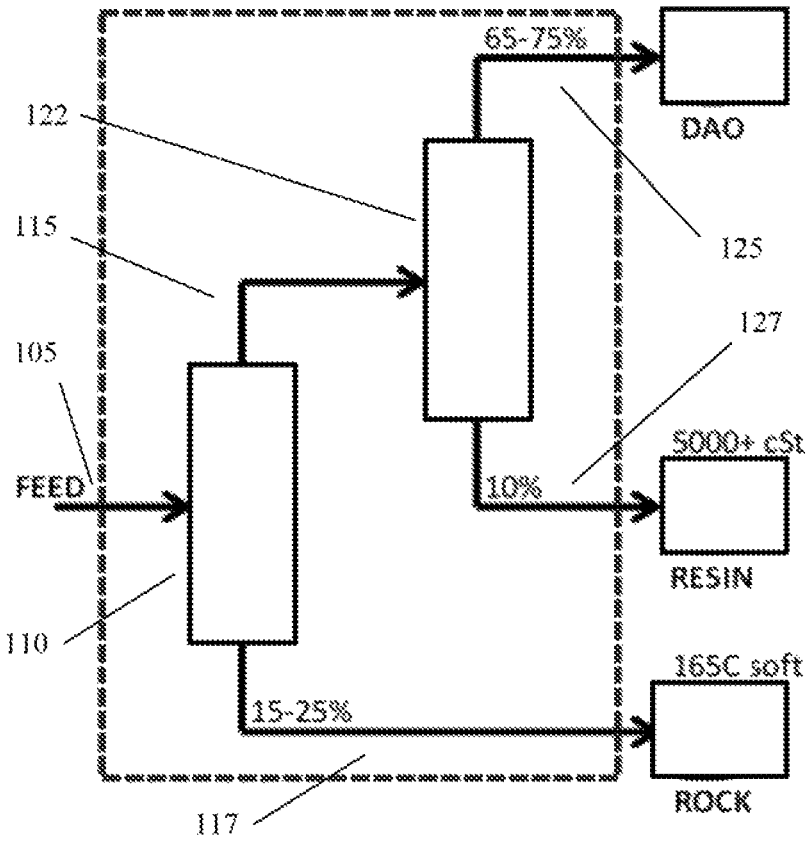
FIG. 3 schematically shows an example of a configuration for a three-product deasphalter based on sequential deasphalting.

FIG. 3 shows an example of a sequential deasphalting configuration. In FIG. 3, the elements within the dotted area correspond to the elements of the sequential deasphalter. In FIG. 3, a feed 105 is introduced into a first deasphalting stage 110. The first deasphalting stage 110 produces a first deasphalted oil 115 and a rock fraction 117. The first deasphalted oil 115 is then passed into a second deasphalting stage 120. The second deasphalting stage 120 produces a second deasphalted oil 125 and a resin fraction 127. It is noted that the configuration shown in FIG. 3 is shown during a sequential deasphalting process to form a resin fraction with a high kinematic viscosity at 100° C.

As another alternative, sequential deasphalting can be performed so that a first deasphalting process is the lower lift process. This can result in formation of deasphalted oil and a deasphalter bottoms fraction. The deasphalter bottoms can then be exposed to a second deasphalting process using a second solvent that can provide higher lift during deasphalting. The products from the second deasphalter process can be a resin type product and rock.

Still another option for forming a resin fraction can be to use a resin settler to separate a resin portion from a deasphalted oil. During solvent deasphalting, a feed (such as a vacuum resid fraction) is mixed with a suitable solvent. This results in a phase separation to form a first phase corresponding to deasphalted oil plus a majority of the solvent and a second phase corresponding to deasphalter residue or rock plus a minor portion of the solvent. If only two products are desired, the solvent can be removed from the deasphalted oil to form a deasphalted oil product. If an additional resin product is desired, a resin settler can be used to separate resin from the deasphalted oil prior to separation of the solvent from the deasphalted oil. The resin can be formed by allowing heavier portions of the deasphalted oil to settle (such as based on gravity or centrifugation) to form a separate resin phase. The temperature of the solvent/deasphalted oil mixture can typically also be adjusted to further facilitate separation of heavier and/or marginally soluble compounds from the deasphalted oil to form the resin. After separation of the deasphalted oil from the resin, both the deasphalted oil and the resin can undergo a further separation to remove the deasphalting solvent from the deasphalted oil and resin.

After production of three products during deasphalting, the three products can be used to form a slate of products that allow multiple objectives to be satisfied. In particular, a slate of products can be formed that allows for a) improved quality for a high value fuels or lubricant feed; b) maintains quality for an asphalt product, and c) reduces or minimizes the production of fuel oil that is required in order to find a disposition for the total deasphalter products.

Additionally or alternately, production of a resin product can provide additional options for formation of asphalt products, such as production of asphalt via air blowing.

In this discussion, when two sets of deasphalting conditions are compared, the deasphalting conditions may be described based on the relative lift or yield from the deasphalting processes. Solvent deasphalting processes generally form a first product with higher solubility in the solvent and a second product that corresponds to a residual product with lower solubility in the solvent. The "lift" or yield of a deasphalting process generally corresponds to the amount of the first product (soluble in the solvent) that is generated during solvent deasphalting. Thus, "higher lift" deasphalting conditions refer to solvent deasphalting conditions that result in production of a larger amount of the first product and a correspondingly lower amount of residual product. Generally, use of a deasphalting solvent containing a higher number of carbon atoms per molecule will correspond to higher lift deasphalting conditions. For example, solvent deasphalting processes using a $C_5$ solvent generally correspond to higher lift deasphalting processes than solvent deasphalting processes that use a $C_3$ solvent. Another example of a change in conditions that can result in higher deasphalter lift or yield is performing a deasphalting process at a lower temperature.

Feedstocks

In various aspects, at least a portion of a feedstock for processing as described herein can correspond to a vacuum resid fraction or another type 950° F.+ (510° C.+), or 1000° F.+ (538° C.+) fraction, or 1050° F.+ (566° C.+) fraction. Another example of a method for forming a 950° F.+ (510° C.+) fraction, or 1000° F.+ (538° C.+) fraction, or 1050° F.+ (566° C.+) fraction, is to perform a high temperature flash separation. The 950° F.+ (510° C.+), 1000° F.+ (538° C.+), or 1050° F.+ (566° C.+) fraction formed from the high temperature flash can be processed in a manner similar to a vacuum resid.

A vacuum resid fraction or a 510° C.+ fraction (or 538° C.+ fraction or 566° C.+ fraction) formed by another process (such as a flash fractionation bottoms or a bitumen fraction) can be deasphalted at high lift to form a deasphalted oil. Optionally, the feedstock can also include a portion of a conventional feed for lubricant base stock production, such as a vacuum gas oil.

A vacuum resid (or other 510° C.+/538° C.+/566° C.+) fraction can correspond to a fraction with a T5 distillation point (ASTM D2892, or ASTM D7169 if the fraction will not completely elute from a chromatographic system) of 900° F. (482° C.) or higher, or 950° F. (510° C.) or higher, or 1000° F. (538° C.) or higher. Alternatively, a vacuum resid fraction can be characterized based on a T10 distillation point (ASTM D2892/D7169) of 900° F. (482° C.) or higher, or 950° F. (510° C.) or higher, or 1000° F. (538° C.) or higher.

Resid (or other 510° C.+) fractions can be high in metals. For example, a resid fraction can be high in total nickel, vanadium and iron contents. In an aspect, a resid fraction can contain 0.00005 grams of Ni/V/Fe (50 wppm) or more, or 0.0002 grams of Ni/V/Fe (200 wppm) per gram of resid or more, on a total elemental basis of nickel, vanadium and iron. In other aspects, the heavy oil can contain 500 wppm or more of nickel, vanadium, and iron, such as up to 1000 wppm or more.

Contaminants such as nitrogen and sulfur are typically found in resid (or other 510° C.+) fractions, often in organically-bound form. Nitrogen content can range from 50 wppm to 10,000 wppm elemental nitrogen or more, based on total weight of the resid fraction. Sulfur content can range from 500 wppm to 100,000 wppm elemental sulfur or more, based on total weight of the resid fraction, or from 1000 wppm to 50,000 wppm, or from 1000 wppm to 30,000 wppm.

Still another method for characterizing a resid (or other 510° C.+) fraction is based on the Conradson carbon residue (CCR) of the feedstock. The Conradson carbon residue of a resid fraction can be 5 wt % or more, such as 10 wt % or more, or 20 wt % or more. Additionally or alternately, the Conradson carbon residue of a resid fraction can be 50 wt % or less, such as 40 wt % or less or 30 wt % or less.

In some aspects, a vacuum gas oil fraction can be co-processed with a deasphalted oil. The vacuum gas oil can be combined with the deasphalted oil in various amounts ranging from 20 parts (by weight) deasphalted oil to 1 part vacuum gas oil (i.e., 20:1) to 1 part deasphalted oil to 1 part vacuum gas oil. In some aspects, the ratio of deasphalted oil to vacuum gas oil can be at least 1:1 by weight, or at least 1.5:1, or at least 2:1. Typical (vacuum) gas oil fractions can include, for example, fractions with a T5 distillation point to T95 distillation point of 650° F. (343° C.)-1050° F. (566° C.), or 650° F. (343° C.)-1000° F. (538° C.), or 650° F. (343° C.)-950° F. (510° C.), or 650° F. (343° C.)-900° F. (482° C.), or ~700° F. (370° C.)-1050° F. (566° C.), or ~700° F. (370° C.)-1000° F. (538° C.), or ~700° F. (370° C.)-950° F. (510° C.), or ~700° F. (370° C.)-900° F. (482° C.), or 750° F. (399° C.)-1050° F. (566° C.), or 750° F. (399° C.)-1000° F. (538° C.), or 750° F. (399° C.)-950° F. (510° C.), or 750° F. (399° C.)-900° F. (482° C.). For example a suitable vacuum gas oil fraction can have a T5 distillation point of 343° C. or higher and a T95 distillation point of 566° C. or less; or a T10 distillation point of 343° C. or higher and a T90 distillation point of 566° C. or less; or a T5 distillation point of 370° C. or higher and a T95 distillation point of 566° C. or less; or a T5 distillation point of 343° C. or higher and a T95 distillation point of 538° C. or less. Optionally, the vacuum gas oil fraction can correspond to a heavy vacuum gas oil that has a T10 distillation point of 482° C. or higher, or 510° C. or higher.

Solvent Deasphalting

Solvent deasphalting is a solvent extraction process. In some aspects, suitable solvents for high yield deasphalting methods as described herein include alkanes or other hydrocarbons (such as alkenes) containing 4 to 7 carbons per molecule, or 5 to 7 carbons per molecule. Examples of suitable solvents include n-butane, isobutane, n-pentane, $C_{4+}$ alkanes, $C_{5+}$ alkanes, $C_{4+}$ hydrocarbons, and $C_{5+}$ hydrocarbons. In some aspects, suitable solvents for low yield deasphalting can include $C_3$ hydrocarbons, such as propane, or alternatively $C_3$ and/or $C_4$ hydrocarbons. Examples of suitable solvents for low yield deasphalting include propane, n-butane, isobutane, n-pentane, $C_{3+}$ alkanes, $C_{4+}$ alkanes, $C_{3+}$ hydrocarbons, and $C_{4+}$ hydrocarbons.

In this discussion, a solvent comprising $C_n$ (hydrocarbons) is defined as a solvent composed of at least 80 wt % of alkanes (hydrocarbons) having n carbon atoms, or at least 85 wt %, or at least 90 wt %, or at least 95 wt %, or at least 98 wt %. Similarly, a solvent comprising $C_{n+}$ (hydrocarbons) is defined as a solvent composed of at least 80 wt % of alkanes (hydrocarbons) having n or more carbon atoms, or at least 85 wt %, or at least 90 wt %, or at least 95 wt %, or at least 98 wt %.

In this discussion, a solvent comprising $C_n$ alkanes (hydrocarbons) is defined to include the situation where the solvent corresponds to a single alkane (hydrocarbon) containing n carbon atoms (for example, n=3, 4, 5, 6, 7) as well as the situations where the solvent is composed of a mixture of alkanes (hydrocarbons) containing n carbon atoms. Similarly, a solvent comprising $C_{n+}$ alkanes (hydrocarbons) is defined to include the situation where the solvent corresponds to a single alkane (hydrocarbon) containing n or more carbon atoms (for example, n=3, 4, 5, 6, 7) as well as the situations where the solvent corresponds to a mixture of alkanes (hydrocarbons) containing n or more carbon atoms. Thus, a solvent comprising $C_{4+}$ alkanes can correspond to a solvent including n-butane; a solvent include n-butane and isobutane; a solvent corresponding to a mixture of one or more butane isomers and one or more pentane isomers; or any other convenient combination of alkanes containing 4 or more carbon atoms. Similarly, a solvent comprising $C_{5+}$ alkanes (hydrocarbons) is defined to include a solvent corresponding to a single alkane (hydrocarbon) or a solvent corresponding to a mixture of alkanes (hydrocarbons) that contain 5 or more carbon atoms. Alternatively, other types of solvents may also be suitable, such as supercritical fluids. In various aspects, the solvent for solvent deasphalting can consist essentially of hydrocarbons, so that at least 98 wt % or at least 99 wt % of the solvent corresponds to compounds containing only carbon and hydrogen. In aspects where the deasphalting solvent corresponds to a $C_{4+}$ deasphalting solvent, the $C_{4+}$ deasphalting solvent can include less than 15 wt % propane and/or other $C_3$ hydrocarbons, or less than 10 wt %, or less than 5 wt %, or the $C_{4+}$ deasphalting solvent can be substantially free of propane and/or other $C_3$ hydrocarbons (less than 1 wt %). In aspects where the deasphalting solvent corresponds to a $C_{5+}$ deasphalting solvent, the $C_{5+}$ deasphalting solvent can include less than 15 wt % propane, butane and/or other $C_3$-$C_4$ hydrocarbons, or less than 10 wt %, or less than 5 wt %, or the $C_{5+}$ deasphalting solvent can be substantially free of propane, butane, and/or other $C_3$-$C_4$ hydrocarbons (less than 1 wt %). In aspects where the deasphalting solvent corresponds to a $C_{3+}$ deasphalting solvent, the $C_{3+}$ deasphalting solvent can include less than 10 wt % ethane and/or other $C_2$ hydrocarbons, or less than 5 wt %, or the $C_{3+}$ deasphalting solvent can be substantially free of ethane and/or other $C_2$ hydrocarbons (less than 1 wt %).

Deasphalting of heavy hydrocarbons, such as vacuum resids, is known in the art and practiced commercially. A deasphalting process typically corresponds to contacting a heavy hydrocarbon with an alkane solvent (propane, butane, pentane, hexane, heptane etc. and their isomers), either in pure form or as mixtures, to produce two types of product streams. One type of product stream can be a deasphalted oil extracted by the alkane, which is further separated to produce deasphalted oil stream. A second type of product stream can be a residual portion of the feed not soluble in the solvent, often referred to as rock or asphaltene fraction. The deasphalted oil fraction can be further processed into make fuels or lubricants. The rock fraction can be further used as blend component to produce asphalt, fuel oil, and/or other products. The rock fraction can also be used as feed to gasification processes such as partial oxidation, fluid bed combustion or coking processes. The rock can be delivered to these processes as a liquid (with or without additional components) or solid (either as pellets or lumps).

During solvent deasphalting, a resid boiling range feed (optionally also including a portion of a vacuum gas oil feed) can be mixed with a solvent. Portions of the feed that are soluble in the solvent are then extracted, leaving behind a residue with little or no solubility in the solvent. The portion of the deasphalted feedstock that is extracted with the solvent is often referred to as deasphalted oil. Typical solvent deasphalting conditions include mixing a feedstock fraction with a solvent in a weight ratio of from 1:2 to 1:10, such as 1:8 or less. Typical solvent deasphalting temperatures range from 40° C. to 200° C., or 40° C. to 150° C., depending on the nature of the feed and the solvent. The pressure during solvent deasphalting can be from 50 psig (345 kPag) to 1000 psig (~6900 kPag).

It is noted that the above solvent deasphalting conditions represent a general range, and the conditions will vary depending on the feed. For example, under typical deasphalting conditions, increasing the temperature can tend to reduce the yield (or lift) while increasing the quality of the resulting deasphalted oil. Under typical deasphalting conditions, increasing the molecular weight of the solvent can tend to increase the yield while reducing the quality of the resulting deasphalted oil, as additional compounds within a resid fraction may be soluble in a solvent composed of higher molecular weight hydrocarbons. Under typical deasphalting conditions, increasing the amount of solvent can tend to increase the yield of the resulting deasphalted oil. As understood by those of skill in the art, the conditions for a particular feed can be selected based on the resulting yield of deasphalted oil from solvent deasphalting. In aspects where a $C_3$ deasphalting solvent is used, the yield from solvent deasphalting can be 40 wt % or less. In some aspects, $C_4$ deasphalting can be performed with a yield of deasphalted oil of 50 wt % or less, or 40 wt % or less. In various aspects, the yield of deasphalted oil from solvent deasphalting with a $C_{4+}$ solvent can be 50 wt % or more relative to the weight of the feed to deasphalting, or 55 wt % or more, or 60 wt % or more, or 65 wt % or more, or 70 wt % or more. In aspects where the feed to deasphalting includes a vacuum gas oil portion, the yield from solvent deasphalting can be characterized based on a yield by weight of a 950° F.+ (510° C.) portion of the deasphalted oil relative to the weight of a 510° C.+ portion of the feed. In such aspects where a $C_{4+}$ solvent is used, the yield of 510° C.+ deasphalted oil from solvent deasphalting can be 40 wt % or more relative to the weight of the 510° C.+ portion of the feed to deasphalting, or 50 wt % or more, or 55 wt % or more, or 60 wt % or more, or 65 wt % or more, or 70 wt % or more. In such aspects where a $C_{4-}$ solvent is used, the yield of 510° C.+ deasphalted oil from solvent deasphalting can be 50 wt % or less relative to the weight of the 510° C.+ portion of the feed to deasphalting, or 40 wt % or less, or 35 wt % or less.

In some aspects, a three-product deasphalter can correspond to a system that allows for sequential deasphalting to form a deasphalted oil product, a resin product, and a deasphalter residue or rock product. In some aspects, sequential deasphalting can involve using a different deasphalting solvent in a first deasphalting stage and a second deasphalting stage, such as a larger hydrocarbon (for higher lift deasphalting) in a first stage, and a smaller hydrocarbon (for lower lift deasphalting) in a second stage. In some aspects, the relative lift between stages during sequential deasphalting can be modified at least in part by using a different deasphalting temperature in the different stages, with higher temperatures generally corresponding to deaspahlting processes with lower lift.

Use of Three-Product Deasphalting to Form Improved Product Slates

One of the difficulties with processing heavy oil feeds is finding a commercially viable disposition for the total feed. As an example, solvent deasphalting can be a useful process for producing a higher quality deasphalted oil from a vacuum resid portion of a feedstock. However, deasphalting also results in generation of a lower quality deasphalter residue or rock product. If a reasonably high value disposition cannot be identified for the rock product, it may not be economically viable to perform deasphalting in the first place. Instead, if a suitable product disposition is not available, the total vacuum resid fraction may be used as a fuel oil blend component, rather than attempting to convert a portion of the resid fraction to higher value products.

A related constraint on processing of heavy oil feeds is the ability to form asphalt fractions that are suitable for further commercial use. Asphalt can be used in a variety of applications, such as road surfaces and roofing tiles. In order to be suitable for such applications, an asphalt product may often be required to possess one or more characteristics. Part of the difficulty in finding a disposition for all portions of a heavy oil feed can be related to the requirement to make an asphalt that meets a target set of characteristics. An example of such a characteristic is the penetration depth (at 25° C.) for an asphalt. Common target penetration grades for asphalts at 25° C. include 65 dmm and 195 dmm. Other characteristics can include softening point (° C.) and dynamic viscosity (Pa-sec). Forming a product slate with an asphalt that meets a desired or target set of characteristics can be in contrast to forming a product slate where a substantial portion of the rock and/or resin and/or asphalt fraction from deasphalting requires thermal cracking in order to form desired products.

Still another practical constraint on heavy oil processing can be forming a product slate that is consistent with the initial feed slate. Vacuum resid fractions are formed as a bottoms product during vacuum distillation of a heavy feed. Other fractions formed during vacuum distillation can correspond to one or more vacuum gas oil fractions, possibly including a heavy vacuum gas oil. Such vacuum gas oil fractions represent potentially higher value feeds than a vacuum resid fraction. For example, vacuum gas oil fractions are typically suitable without further blending for use as a feed for lubricant and/or fuels production. When a vacuum resid fraction is deasphalted, forming a desired or target grade of asphalt can require incorporation of a portion of the vacuum gas oil fraction from a feed slate to balance out the rock product from deasphalting. Such incorporation of vacuum gas oil into a lower value product can substantially reduce the benefits of the deasphalting process.

In various aspects, use of a three-product deasphalting system can allow for production of an improved slate of products while working within the practical constraints that imposed when attempting to determine product dispositions for the full range of a feed slate. For example, using a three-product deasphalter can allow for production of a higher quality feed for distillate fuel production while maintaining target asphalt quality and reducing or minimizing production of lower value side products such as fuel oil. Optionally, the volume of the product slate that contains the products from a three-product deasphalter can be compared with the volume of the heavy vacuum gas oil and vacuum resid (i.e., bottoms) generated during distillation. In some aspects, the volume of the product slate based on blending of the heavy vacuum gas oil and the products from the three-product deasphalter can correspond to 95 wt % or more of the combined volume of the heavy vacuum gas oil and the vacuum resid, or 98 wt % or more. In some aspects, the volume of the product slate based on blending of the heavy vacuum gas oil and the products from the three-product deasphalter can correspond to 105 wt % or less of the combined volume of the heavy vacuum gas oil and the vacuum resid, or 102 wt % or more.

As an example, Table 1 shows modeling calculations for feed and initial deasphalter product properties for distillation and deasphalting of the heavy oil portion of a crude slate. The model corresponds to an empirical model based on both pilot and commercial scale data. The crude slate represented in the model corresponds to a mixture of commercially available crude sources. In Table 1, the "HVGO" and "VTB" rows refer to the amount of heavy vacuum gas oil and vacuum tower bottoms that are produced, respectively, during vacuum distillation of an input crude slate. It is noted that the "HVGO" and "VTB" amounts do not change in Table 1. Table 1 also includes rows for deasphalted oil (DAO), resin, and rock production. These represent deasphalted products formed from deasphalting of the "VTB" portion of the crude slate. The columns show two-product and three-product desaphalting configurations using a $C_5$ solvent, a $C_4$ solvent, or a $C_3$ solvent. For the three-product deasphalting configurations, the resin is formed by performing sequential deasphalting, with the first stage being roughly the same as the corresponding two-product deasphalting configuration, and the second stage corresponding to a deasphalting process performed on the deasphalted oil from the first stage with the same solvent but at a higher temperature. Thus, the amount of DAO varies between the two-product and three-product deasphalter configurations for a given solvent type, while the rock fractions are the same.

The deasphalter solvents corresponded to n-pentane ($C_5$), n-butane ($C_4$), and propane ($C_3$).

TABLE 1

| | Deasphalter Products | | | | | |
|---|---|---|---|---|---|---|
| kB/day | C5/2prod | C5/3prod | C4/2prod | C4/3prod | C3/2prod | C3/3prod |
| HVGO | 9.4 | 9.4 | 9.4 | 9.4 | 9.4 | 9.4 |
| VTB | 17.0 | 17.0 | 17.0 | 17.0 | 17.0 | 17.0 |
| DAO | 14.3 | 13.0 | 11.0 | 9.9 | 5.7 | 4.2 |
| Resin | 0.0 | 1.3 | 0.0 | 1.1 | 0.0 | 1.5 |
| Rock | 2.7 | 2.7 | 6.0 | 6.0 | 11.3 | 11.3 |

After performing deasphalting, the model was used to blend the heavy vacuum gas oil and the deasphalter products into commercial products. In this example, the heavy vacuum gas oil and the deasphalter products were blended to form a) a feed suitable for hydrotreatment prior to fluid catalytic cracking, for formation of distillate fuel products; b) an asphalt having a penetration at 25° C. of 65 dmm or less; and c) fuel oil, to the degree necessary to dispose of the full range of deasphalter products.

Table 2 shows the blends predicted in the model to form the feed for eventual catalytic cracking for fuels production. Table 2 also shows model predictions of properties for the resulting blends.

TABLE 2

| Catalytic Cracking Feed Blends | | | | | | |
|---|---|---|---|---|---|---|
| kB/day | C5/2prod | C5/3prod | C4/2prod | C4/3prod | C3/2prod | C3/3prod |
| HVGO | 6.4 | 6.4 | 9.0 | 9.3 | 8.9 | 8.9 |
| DAO | 12.0 | 10.6 | 7.9 | 5.8 | 4.7 | 3.4 |
| Subtotal | 18.4 | 16.8 | 16.9 | 15.1 | 13.6 | 12.3 |
| API Gravity (°) | 13.2 | 14.2 | 16.3 | 17.1 | 18.7 | 19.0 |
| CCR (wt %) | 9.6 | 7.9 | 4.5 | 3.3 | 1.6 | 1.3 |

As shown in Table 2, the feed for eventual fluid catalytic cracking corresponds to a blend of heavy vacuum gas oil and deasphalted oil. However, less than the full amount of both the heavy vacuum gas oil and the deasphalted oil is used for forming the catalytic cracking feed. Even though the catalytic cracking feed represents the highest value "product" in the deasphalter/HVGO product slate, a portion of the deasphalted oil and/or the heavy vacuum gas oil is needed for formation of other products. More generally, a feed for catalytic cracking (for fuels production) or a feed for lubricant production, as generated by blending of products from three-product deasphalting, can have an API Gravity of 14 or more, or 16 or more. Additionally or alternately, such a feed can have a Conradson Carbon content of 10 wt % or less, or 8.0 wt % or less, or 6.0 wt % or less.

Table 2 also shows product quality characteristics for the catalytic cracking feed. The product qualities shown in Table 2 include API Gravity and Conradson Carbon content. As shown in Table 2, for the same type of deasphalting solvent, use of a three-product deasphalter allows for production of a higher quality catalytic cracking feed, but at a lower yield. The higher quality is demonstrated by the higher API Gravity (i.e., lower density) and the lower Conradson Carbon content. Further discussion of the product qualities as part of the full product slate will be provided below.

Table 3 shows the blends predicted in the model to form an asphalt having the desired penetration at 25° C. Table 3 also shows the predicted product quality for the resulting asphalt blend.

TABLE 3

| Asphalt Blends | | | | | | |
|---|---|---|---|---|---|---|
| kB/day | C5/2prod | C5/3prod | C4/2prod | C4/3prod | C3/2prod | C3/3prod |
| Rock | 2.7 | 2.7 | 3.3 | 3.7 | 5.2 | 5.3 |
| Resin | 0.0 | 0.4 | 0.0 | 0.2 | 0.0 | 0.5 |
| DAO | 2.4 | 2.4 | 3.1 | 4.0 | 1.1 | 0.9 |
| HVGO | 3.0 | 3.2 | 0.4 | 0.1 | 0.5 | 0.5 |
| Subtotal | 8.0 | 8.7 | 6.8 | 8.1 | 6.8 | 7.1 |
| Penetration @ 25° C. (dmm) | 65 | 65 | 65 | 65 | 65 | 65 |
| Softening (° C.) | 49.1 | 49.3 | 47.7 | 47.7 | 46.5 | 46.5 |
| Dynamic viscosity @ 60° C. (Pa-sec) | 238 | 238 | 238 | 238 | 208 | 208 |

In Table 3, the Rock, Resin, DAO, and HVGO rows represent the amount of each deasphalter product fraction (or the HVGO fraction) that was included in the asphalt blend. The subtotal represents the asphalt product yield. In Table 3, all of the asphalt blends had a penetration at 25° C. of 65 dmm. The asphalt blends for each deasphalting solvent also have roughly the same softening temperature and same dynamic viscosity at 60° C. As shown in Table 3, a higher yield of asphalt was generated when using the three-product deasphalter for a given deasphalting solvent.

A remaining portion of the deasphalter products was then used to form fuel oil. Table 4 shows the fuel oil blends formed so that the full deasphalter product slate was modeled as being included in a commercial product.

TABLE 4

| Fuel Oil Blends | | | | | | |
|---|---|---|---|---|---|---|
| kB/day | C5/2prod | C5/3prod | C4/2prod | C4/3prod | C3/2prod | C3/3prod |
| Resin | 0.0 | 0.8 | 0.0 | 0.9 | 0.0 | 1.0 |
| Rock | 0.0 | 0.0 | 2.7 | 2.3 | 6.1 | 6.0 |
| Subtotal | 0.0 | 0.8 | 2.7 | 3.2 | 6.1 | 7.0 |

As shown in Table 4, for a given deasphalter solvent, use of the three-product deasphalting results in an increase in the amount of fuel oil generated.

Taken in combination, Tables 2, 3, and 4 allow for demonstration of the benefits that can be achieved using a three-product deasphalter. In particular, use of a three-product deasphalter can be beneficial when it is desired to improve the product quality of a feed for fuels or lubricant production while maintaining a desired asphalt quality and while reducing or minimizing production of lower value products, such as fuel oil.

To illustrate the benefits, the products from two-product deasphalting using a Cs solvent can be used as a baseline. Using two-product deasphalting, if it is desired to improve the quality of the catalytic cracking feed, the lift of the deasphalting has to be reduced. This is illustrated by the switch to using a $C_4$ solvent. In Tables 2, 3, and 4, use of a $C_4$ solvent in two-product deasphalting was able to generate an asphalt of comparable quality to the asphalt from $C_5$ two-product deasphalting. The quality of the catalytic cracking feed was also improved. However, the need to have a disposition for all of the deasphalter products required production of a substantial portion of fuel oil. By contrast, a comparable improvement in catalytic cracking feed quality could also be obtained using the $C_5$ solvent in a three-product deasphalter configuration. A comparable asphalt was also produced. Although the yield of the catalytic cracking feed was lower, the amount of fuel oil generated was also lower (0.8 kB/day versus 2.7 kB/day). Thus, use of a three-product deasphalter provided a method for reducing or minimizing production of a low value fuel oil product while also improving the quality of the catalytic cracking feed. Although direct comparisons are more difficult, a similar benefit can be achieved when attempting to improve the catalytic cracking feed produced using a two-product deasphalter with a $C_4$ solvent.

Hydrotreating and Hydrocracking

After deasphalting, the deasphalted product fractions (and any additional fractions combined with the deasphalter product fraction) can undergo further processing, such as further processing to form lubricant base stocks, further processing prior to performing fluid catalytic cracking, and/or further processing for any other convenient purpose. This can include hydrotreatment and/or hydrocracking to remove heteroatoms to desired levels, reduce Conradson Carbon content, and/or provide viscosity index (VI) uplift. Depending on the aspect, a deasphalted oil can be hydroprocessed by demetallization, hydrotreating, hydrocracking, or a combination thereof. Similarly, a resin fraction generated by sequential deasphalting can be hydroprocessed by demetallization, hydrotreating, hydrocracking, or a combination thereof.

The deasphalted oil (or a resin fraction) can be hydrotreated and/or hydrocracked with little or no solvent extraction being performed prior to and/or after the deasphalting. As a result, the deasphalted oil feed (or a feed based on a resin fraction) for hydrotreatment and/or hydrocracking can have a substantial aromatics content. In various aspects, the aromatics content of the deasphalted oil feed (or a feed based on a resin fraction) can be 50 wt % or more, or 55 wt % or more, or 60 wt % or more, or 65 wt % or more, or 70 wt % or more, or 75 wt % or more, such as up to 90 wt % or more. Additionally or alternately, the saturates content of the deasphalted oil feed (or a feed based on a resin fraction) can be 50 wt % or less, or 45 wt % or less, or 40 wt % or less, or 35 wt % or less, or 30 wt % or less, or 25 wt % or less, such as down to 10 wt % or less. In this discussion and the claims below, the aromatics content and/or the saturates content of a fraction can be determined based on ASTM D7419.

The reaction conditions during hydrotreatment and/or hydrocracking of a feed including a fraction generated during sequential deasphalting can be selected to reduce the sulfur content of the feed to a desired level. For example, prior to hydrotreatment, a resin fraction can contain from 1.0 wt % to 4.0 wt % sulfur. Hydrotreatment can be used to reduce the sulfur content of the resin fraction (or another feed containing a product from deasphalting) to 1.0 wt % or less, or 0.5 wt % or less, such as down to 500 wppm, or down to 300 wppm, or still lower.

In various aspects, a feed containing a deasphalter product fraction can initially be exposed to a demetallization catalyst prior to exposing the feed to a hydrotreating catalyst. Deasphalted oils can have metals concentrations (Ni+V+Fe) on the order of 10-100 wppm. Other deasphalter products can potentially have still higher metals concentrations. Exposing a conventional hydrotreating catalyst to a feed having a metals content of 10 wppm or more can lead to catalyst deactivation at a faster rate than may desirable in a commercial setting. Exposing a metal containing feed to a demetallization catalyst prior to the hydrotreating catalyst can allow at least a portion of the metals to be removed by the demetallization catalyst, which can reduce or minimize the deactivation of the hydrotreating catalyst and/or other subsequent catalysts in the process flow. Commercially available demetallization catalysts can be suitable, such as large pore amorphous oxide catalysts that may optionally include Group VI and/or Group VIII non-noble metals to provide some hydrogenation activity.

In various aspects, a feed containing a deasphalter product fraction can be exposed to a hydrotreating catalyst under effective hydrotreating conditions. The catalysts used can include conventional hydroprocessing catalysts, such as those comprising at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydroprocessing catalysts optionally include transition metal sulfides that are impregnated or dispersed on a refractory support or carrier such as alumina and/or silica. The support or carrier itself typically has no significant/measurable catalytic activity. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zeolites, titania, silica-titania, and titania-alumina. Suitable aluminas are porous aluminas such as gamma or eta having average pore sizes from 50 to 200 Å, or 75 to 150 Å; a surface area from 100 to 300 $m^2/g$, or 150 to 250 $m^2/g$; and a pore volume of from 0.25 to 1.0 $cm^3/g$, or 0.35 to 0.8 $cm^3/g$. More generally, any convenient size, shape, and/or pore size distribution for a catalyst suitable for hydrotreatment of a distillate (including lubricant base stock) boiling range feed in a conventional manner may be used. Preferably, the support or carrier material is an amorphous support, such as a refractory oxide. Preferably, the support or carrier material can be free or substantially free of the presence of molecular sieve, where substantially free of molecular sieve is defined as having a content of molecular sieve of less than 0.01 wt %.

The at least one Group VIII non-noble metal, in oxide form, can typically be present in an amount ranging from 2 wt % to 40 wt %, preferably from 4 wt % to 15 wt %. The at least one Group VI metal, in oxide form, can typically be present in an amount ranging from 2 wt % to 70 wt %, preferably for supported catalysts from 6 wt % to 40 wt % or from 10 wt % to 30 wt %. These weight percents are based on the total weight of the catalyst. Suitable metal catalysts include cobalt/molybdenum (1-10% Co as oxide, 10-40% Mo as oxide), nickel/molybdenum (1-10%Ni as oxide, 10-40% Co as oxide), or nickel/tungsten (1-10% Ni as oxide, 10-40% W as oxide) on alumina, silica, silica-alumina, or titania.

The hydrotreatment is carried out in the presence of hydrogen. A hydrogen stream is, therefore, fed or injected into a vessel or reaction zone or hydroprocessing zone in which the hydroprocessing catalyst is located. Hydrogen, which is contained in a hydrogen "treat gas," is provided to the reaction zone. Treat gas, as referred to in this invention, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane). The treat gas stream introduced into a reaction stage will preferably contain 50 vol. % or more, and more preferably 75 vol. % hydrogen or more. Optionally, the hydrogen treat gas can be substantially free (less than 1 vol %) of impurities such as $H_2S$ and $NH_3$ and/or such impurities can be substantially removed from a treat gas prior to use.

Hydrogen can be supplied at a rate of from 100 SCF/B (standard cubic feet of hydrogen per barrel of feed) (17 $Nm^3/m^3$) to 10000 SCF/B (1700 $Nm^3/m^3$). Preferably, the hydrogen is provided in a range of from 200 SCF/B (34 $Nm^3/m^3$) to 2500 SCF/B (420 $Nm^3/m^3$). Hydrogen can be supplied co-currently with the input feed to the hydrotreatment reactor and/or reaction zone or separately via a separate gas conduit to the hydrotreatment zone.

Hydrotreating conditions can include temperatures of 200° C. to 450° C., or 315° C. to 425° C.; pressures of 250 psig (1.8 MPag) to 5000 psig (34.6 MPag) or 300 psig (2.1 MPag) to 3000 psig (20.8 MPag); liquid hourly space velocities (LHSV) of 0.1 $hr^{-1}$ to 10 $hr^{-1}$; and hydrogen treat rates of 200 scf/B (35.6 $m^3/m^3$) to 10,000 scf/B (1781 $m^3/m^3$), or 500 (89 $m^3/m^3$) to 10,000 scf/B (1781 $m^3/m^3$).

In various aspects, a feed containing a deasphalter product fraction can be exposed to a hydrocracking catalyst under effective hydrocracking conditions. Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports include acidic molecular sieves, such as zeolites or silicoaluminophophates. One example of suitable zeolite is USY, such as a USY zeolite with cell size of 24.30 Angstroms or less. Additionally or alternately, the catalyst can be a low acidity molecular sieve, such as a USY zeolite with a Si to Al ratio of at least 20, and preferably at least 40 or 50. ZSM-48, such as ZSM-48 with a $SiO_2$ to $Al_2O_3$ ratio of 110 or less, such as 90 or less, is another example of a potentially suitable hydrocracking catalyst. Still another option is to use a combination of USY and ZSM-48. Still other options include using one or more of zeolite Beta, ZSM-5, ZSM-35, or ZSM-23, either alone or in combination with a USY catalyst. Non-limiting examples of metals for hydrocracking catalysts include metals or combinations of metals that include at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can also be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in one embodiment).

When only one hydrogenation metal is present on a hydrocracking catalyst, the amount of that hydrogenation metal can be 0.1 wt % or more based on the total weight of the catalyst, for example 0.5 wt % or more, or 0.6 wt % or more. Additionally or alternately when only one hydrogenation metal is present, the amount of that hydrogenation metal can be 5.0 wt % or less based on the total weight of the catalyst, for example 3.5 wt % or less, 2.5 wt % or less, 1.5 wt % or less, 1.0 wt % or less, 0.9 wt % or less, 0.75 wt % or less, or 0.6 wt % or less. Further additionally or alternately when more than one hydrogenation metal is present, the collective amount of hydrogenation metals can be 0.1 wt % or more based on the total weight of the catalyst, for example 0.25 wt % or more, 0.5 wt % or more, 0.6 wt % or more, 0.75 wt % or more, or 1.0 wt % or more. Still further additionally or alternately when more than one hydrogenation metal is present, the collective amount of hydrogenation metals can be 35 wt % or less based on the total weight of the catalyst, for example 30 wt % or less, 25 wt % or less, 20 wt % or less, 15 wt % or less, 10 wt % or less, or 5.0 wt % or less. In embodiments wherein the supported metal comprises a noble metal, the amount of noble metal(s) is typically less than 2.0 wt %, for example less than 1.0 wt %, 0.9 wt % or less, 0.75 wt % or less, or 0.6 wt % or less. It is noted that hydrocracking under sour conditions is typically performed using a base metal (or metals) as the hydrogenation metal.

Air Blowing of Resin-Containing Fractions to Form Fit-For-Purpose Asphalt

In some aspects, deasphalting with a $C_{4+}$ deasphalting solvent can be used to produce deasphalted oil at a high lift, such as producing 65 wt % or more of deasphalted oil. In such aspects, sequential deasphalting can be performed to form both a resin fraction and a rock fraction. In such aspects, the resin fraction can correspond to a heavy resin fraction with a viscosity of 5000 cSt or more. A heavy resin fraction can be blended with other fractions to attempt to form a fit-for-purpose asphalt, or air blowing can be used to further assist with forming a fit-for-purpose asphalt.

One feature of an heavy resin fraction can be a reduced content of asphaltenes relative to a typical rock fraction. Based on the reduced content of asphaltenes, air blowing can be an advantageous method for improving the quality of an asphalt fraction containing a heavy resin fraction. It has been discovered that asphaltene-depleted crude oil or bitumen can be improved to a greater degree by air blowing than a conventional crude fraction. Most crudes or crude fractions exhibit similar behavior when oxidized by air blowing. After an initial modest improvement in high temperature properties with little detriment to low temperature properties, further air blowing of a conventional crude results in a predictable trade-off of improved high temperature properties and decreased low temperature properties. Without being bound by any particular theory, it is believed that this trade-off of gaining improved high temperature properties at the expense of less favorable low temperature properties is due to a phase instability in the oxidized crude oil or bitumen. Therefore, air blowing is of limited benefit for production of asphalt from conventional crudes under the SUPERPAVE™ standard used in North America. By contrast, oxidation of asphaltene-depleted crudes by air blowing can be used to improve the high temperature properties to a much greater degree with only a modest impact on the corresponding low temperature properties. As a result, air blowing can be used effectively to upgrade asphaltene-depleted crudes (including mixtures containing asphaltene-depleted crudes) that would otherwise be considered as not suitable for making typical North American asphalt grades.

Various types of systems are available for oxidizing a crude by air blowing. FIG. 1 shows an example of a typical asphalt oxidation process. An asphalt feed is passed via line 10 through heat exchanger 1 where it is preheated to a temperature from 125° C. to 300° C., then to oxidizer vessel 2. Air, via line 12, is also introduced to oxidizer vessel 2 by first compressing it by use compressor 3 then passing it through knockout drum 4 to remove any condensed water or other liquids via line 13. The air flows upward through a distributor 15 and countercurrent to down-flowing asphalt. The air is not only the reactant, but also serves to agitate and mix the asphalt, thereby increasing the surface area and rate of reaction. Oxygen is consumed by the asphalt as the air ascends through the down flowing asphalt. Steam or water can be sprayed (not shown) into the vapor space above the asphalt to suppress foaming and to dilute the oxygen content of waste gases that are removed via line 14 and conducted to knockout drum 5 to remove any condensed or entrained liquids via line 17. The oxidizer vessel 2 is typically operated at low pressures of 0 to 2 barg. The temperature of the oxidizer vessel can be from 150° C. to 300° C., preferably from 200° C. to 270° C., and more preferably from 250° C. to 270° C. It is preferred that the temperature within the oxidizer will be at least 10° C. higher, preferably at least 20° C. higher, and more preferably at least 30° C. higher than the incoming asphalt feed temperature. The low pressure off-gas, which is primarily comprised of nitrogen and water vapor, is often conducted via line 16 to an incinerator 8 where it is burned before being discharged to the atmosphere. The oxidized asphalt product stream is then conducted via line 18 and pumped via pump 6 through heat exchanger 1 wherein it is used to preheat the asphalt feed being conducted to oxidizer vessel 2. The hot asphalt product stream is then conducted via line 20 to steam generator 7 where it is cooled prior to going to storage.

In an alternative configuration, a liquid jet ejector technology can be used to improve the performance of an air blowing process. The liquid jet ejector technology eliminates the need for an air compressor; improves the air/oil mixing compared to that of a conventional oxidizer vessel, thus reducing excess air requirements and reducing the size of the off-gas piping; reduces the excess oxygen in the off-gas allowing it to go to the fuel gas system, thus eliminating the need for an incinerator; and reduces the reaction time, thus reducing the size requirement of the oxidizer vessel.

Liquid jet ejectors are comprised of the following components: a body having an inlet for introducing the motive liquid, a converging nozzle that converts the motive liquid into a high velocity jet stream, a port (suction inlet) on the body for the entraining in of a second liquid or gas, a diffuser (or venturi), and an outlet wherein the mixed liquid stream is discharged.

In a liquid jet ejector, a motive liquid under high pressure flows through converging nozzles into the mixing chamber and at some distance behind the nozzles forms high-velocity and high-dispersed liquid jets, which mix with entrained gas, speeding up the gas and producing a supersonic liquid-gas flow inside the mixing chamber. Kinetic energy of the liquid jet is transferred to the entrained gas in the mixing chamber producing vacuum at the suction inlet. Hypersonic liquid-gas flow enters the throat, where it is decelerated by the compression shocks. Thus, the low pressure zone in the mixing chamber is isolated from the high pressure zones located downstream.

Figure 2:
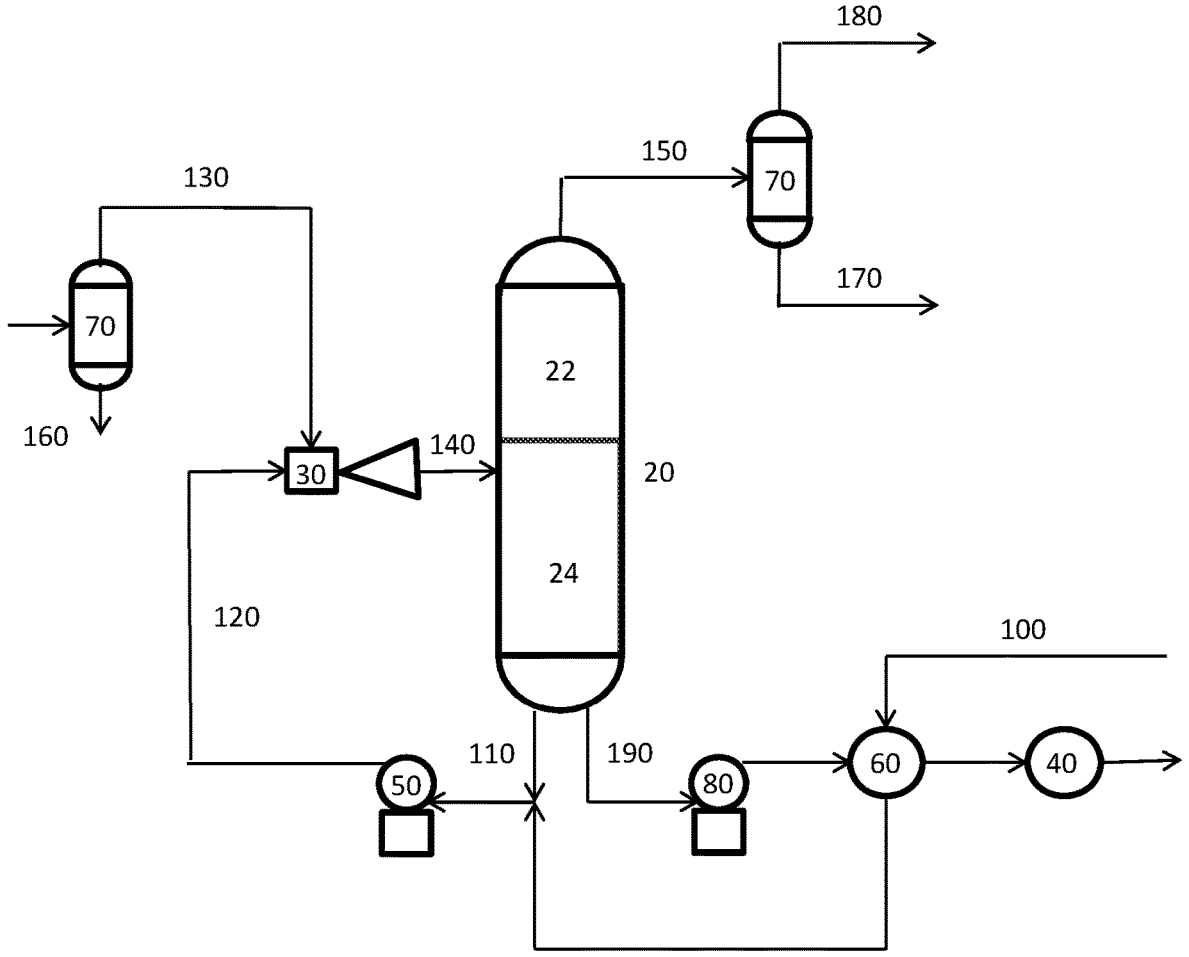
FIG. 2 hereof is a process flow scheme of an asphalt oxidation process.

FIG. 2 hereof is a process flow scheme of a process for oxidizing asphalts using liquid jet ejectors. An asphalt feed via line 100 is preheated in heat exchanger 60 and combined with a portion of the oxidized asphalt product from oxidizer vessel 20 via line 110 and pumped via pump 50 via line 120 to the liquid jet ejector 30 motive inlet and mixed with an effective amount of air via line 130 to liquid jet ejector 30 suction inlet via knockout drum 70. Any liquid collected from knockout drum 70 is drained via line 170. The amount of oxidized asphalt product recycled from the oxidizer will be at least 5 times, preferably at least 10 times, and more preferably at least 20 times that of the volume of incoming asphalt feed. By effective amount of air we mean at least a stoichiometric amount, but not so much that it will cause undesirable results from either a reaction or a process point of view. The stoichiometric amount of air will be determined by the amount of oxidizable components in the particular asphalt feed. It is preferred that a stoichiometric amount of air be used.

Any suitable liquid jet ejector can be used as part of an air blowing oxidation process. Liquid jet ejectors are typically comprised of a motive inlet, a motive nozzle, a suction port, a main body, a venturi throat and diffuser, and a discharge connection, wherein the hot asphalt, at a temperature from 125° C. to 300° C., is conducted as the motive liquid into said motive inlet and wherein air is drawn into the suction port and mixed with the asphalt within the ejector body. The air drawn into the suction port of the liquid jet ejector may be either atmospheric air or compressed air. The pressurized air/asphalt mixture is then conducted via line 140 to oxidizer/separation vessel 20. The pressure of the mixture exiting the liquid jet ejector will be in excess of the pressure at which the oxidizer is operated and will be further adjusted to allow for the resulting off gas from the oxidizer to be introduced into the fuel gas system of the refinery. The oxidizer vessel 20 is operated at pressures from 0 to 10+ barg, preferably from 0 to 5 barg and more preferably from 0 to 2 barg. The temperature of the oxidizer vessel can be from 150° C. to 300° C., preferably from 200° C. to 270° C., and more preferably from 250° C. to 270° C. It is preferred that the temperature within the oxidizer will be at least 10° C. higher, preferably 20° C., and more preferably 30° C. higher than the incoming asphalt feed temperature. Off-gas is collected overhead via line 150 and passed through a knockout drum 70 where liquids are drained off via line 170 for further processing and the vapor because of its pressure and low oxygen content can be routed into the refinery fuel gas system via line 180. The oxidized product is conducted via line 190 through pump 80, heat exchanger 60 and steam generator 40. An effective amount of steam can be conducted (not shown) to the vapor space 22 above or below the asphalt level 24 in the oxidizer 20 to dilute the oxygen content of the off gas, primarily for safety purposes. By effective amount of steam is meant at least that amount needed to dilute the oxygen content of the resulting off gas to a predetermined value.

The oxidized product stream is then routed to product storage via line 190 while a portion of it is recycled via line 110 to line 120 where it is mixed with fresh feed, which functions to provide the necessary motive fluid for the liquid jet ejector.

Additional Embodiments

Embodiment 1. A method for processing a heavy oil fraction, comprising: separating a vacuum gas oil fraction and a vacuum resid fraction from a heavy oil feed; performing solvent deasphalting using a $C_{4+}$ solvent under first solvent deasphalting conditions on at least a portion of the vacuum resid fraction to produce a first deasphalted oil and a first deasphalter residue, the effective solvent deasphalting conditions producing a yield of first deasphalted oil of 50 wt % or more of the feedstock; performing solvent deasphalting on at least a portion of the first deasphalted oil under second solvent deasphalting conditions to form a second deasphalted oil and a second deasphalter resin, the second solvent deasphalting conditions comprising lower lift deasaphlting conditions than the first solvent deasphalting conditions; forming a product slate from at least a portion of a) the vacuum gas oil fraction, b) the first deasphalter residue, c) the second deasphalted oil, and d) the second deasphalter resin, the product slate comprising an asphalt fraction and one or more fuels feeds, lubricant feeds, or a combination thereof, a volume of the product slate comprising 95 vol % or more of a combined volume of the vacuum gas oil fraction and the vacuum resid fraction, or 98 vol % or more; performing further processing on the one or more fuels feeds, lubricant feeds, or a combination thereof, the further processing comprising hydroprocessing, fluid catalytic cracking, or a combination thereof; and incorporating the asphalt fraction into an asphalt product.

Embodiment 2. The method of Embodiment 1, wherein the second deasphalting conditions comprise a deasphalting solvent having a smaller number of carbon atoms per molecule than a deasphalting solvent for the first deasphalting conditions; or wherein the second deasphalting conditions comprise a higher temperature than then first deasphalting conditions; or a combination thereof.

Embodiment 3. The method of any of the above embodiments, wherein a yield of the first deasphalted oil is 60 wt % or more, or 70 wt % or more.

Embodiment 4. The method of any of the above embodiments, wherein the product slate comprises products formed from at least a portion of the first deasphalted oil, at least a portion of the vacuum resid, or a combination thereof.

Embodiment 5. A method for processing a heavy oil fraction, comprising: separating a vacuum gas oil fraction and a vacuum resid fraction from a heavy oil feed; performing solvent deasphalting under first solvent deasphalting conditions on at least a portion of the vacuum resid fraction to produce a first deasphalted oil and a first deasphalter residue, the effective solvent deasphalting conditions producing a yield of first deasphalted oil of 50 wt % or more of the feedstock; performing solvent deasphalting using a $C_{4+}$ solvent on at least a portion of the first deasphalter residue under second solvent deasphalting conditions to form a second deasphalter residue and a second deasphalter resin, the second solvent deasphalting conditions comprising a lower severity than the first solvent deasphalting conditions; forming a product slate from at least a portion of a) the vacuum gas oil fraction, b) the second deasphalter residue, c) the first deasphalted oil, and d) the second deasphalter resin, the product slate comprising an asphalt fraction and one or more fuels feeds, lubricant feeds, or a combination thereof, a volume of the product slate comprising 95 vol % or more of a combined volume of the vacuum gas oil fraction and the vacuum resid fraction, or 98 vol % or more; performing further processing on the one or more fuels feeds, lubricant feeds, or a combination thereof, the further processing comprising hydroprocessing, fluid catalytic cracking, or a combination thereof and incorporating the asphalt fraction into an asphalt product.

Embodiment 6. The method of Embodiment 5, wherein the second deasphalting conditions comprise a deasphalting solvent having a greater number of carbon atoms per molecule than a deasphalting solvent for the first deasphalting conditions; or wherein the second deasphalting conditions comprise a lower temperature than then first deasphalting conditions; or a combination thereof.

Embodiment 7. The method of Embodiment 5 or 6, wherein the product slate comprises products formed from at least a portion of the first deasphalter residue, at least a portion of the vacuum resid, or a combination thereof.

Embodiment 8. The method of any of the above embodiments, wherein the asphalt fraction is incorporated into the asphalt product without exposing the asphalt fraction to thermal cracking conditions.

Embodiment 9. The method of any of the above embodiments, wherein the volume of the product slate comprises 105 vol % or less of the combined volume of the vacuum gas oil fraction and the vacuum resid fraction, or 102 vol % or less.

Embodiment 10. The method of any of the above embodiments, wherein the product slate further comprises a fuel oil fraction.

Embodiment 11. The method of any of the above embodiments, wherein the vacuum gas oil fraction comprises a T10 distillation point of 482° C. or higher, or 510° C. or higher.

Embodiment 12. The method of any of the above embodiments, wherein the one or more fuels feeds, lubricant feeds, or a combination thereof comprise a Conradson Carbon content of 10 wt % or less, or 8.0 wt % or less, or 6.0 wt % or less; or wherein the one or more fuels feeds, lubricant feeds, or a combination thereof comprise an API Gravity of 14 or more, or 16 or more; or a combination thereof.

Embodiment 13. The method of any of the above embodiments, wherein the asphalt fraction comprises at least a portion of the second deasphalter resin, the method further comprising air blowing the asphalt fraction.

Embodiment 14. A product slate formed according to the method of any of the above embodiments.

Embodiment 15. An asphalt composition formed by a process comprising air blowing of an asphalt fraction, the asphalt fraction comprising a deasphalter resin having a kinematic viscosity at 100° C. of 5000 cSt or more.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A method for processing a heavy oil fraction, comprising:

separating a vacuum gas oil fraction and a vacuum resid fraction from a heavy oil feedstock;

performing solvent deasphalting using a $C_3$ or $C_4$ solvent under first solvent deasphalting conditions on at least a portion of the vacuum resid fraction to produce a first deasphalted oil and a first deasphalter residue;

performing solvent deasphalting on at least a portion of the first deasphalted oil under second solvent deasphalting conditions to form a second deasphalted oil and a second deasphalter resin, the second solvent deasphalting conditions comprising higher yield deasphalting conditions than the first solvent deasphalting conditions;

forming a product slate from at least a portion of a) the vacuum gas oil fraction, b) the first deasphalter residue, c) the second deasphalted oil, and d) the second deasphalter resin, the product slate comprising an asphalt fraction and one or more fuels feeds, lubricant feeds, or a combination thereof, a volume of the product slate comprising 95 vol % or more of a combined volume of the vacuum gas oil fraction and the vacuum resid fraction;

performing further processing on the one or more fuels feeds, lubricant feeds, or a combination thereof, the further processing comprising hydroprocessing, fluid catalytic cracking, or a combination thereof; and incorporating the asphalt fraction into an asphalt product.

2. The method of claim 1, wherein the volume of the product slate comprises 105 vol % or less of the combined volume of the vacuum gas oil fraction and the vacuum resid fraction.

3. The method of claim 1, wherein the product slate further comprises a fuel oil fraction.

4. The method of claim 1, wherein the product slate comprises products formed from at least a portion of the first deasphalted oil, at least a portion of the vacuum resid fraction, or a combination thereof.

5. The method of claim 1, wherein the second solvent deasphalting conditions comprise a higher temperature than then first deasphalting conditions; or a combination thereof.

6. The method of claim 1, wherein the vacuum gas oil fraction comprises a T10 distillation point of 482° C. or higher.

7. The method of claim 1, wherein the one or more fuels feeds, lubricant feeds, or a combination thereof comprise a Conradson Carbon content of 10 wt % or less.

8. The method of claim 1, wherein the one or more fuels feeds, lubricant feeds, or a combination thereof comprise an API Gravity of 14 or more.

9. The method of claim 1, wherein a yield of the first deasphalted oil is 60 wt % or more.

10. The method of claim 1, wherein the asphalt fraction comprises at least a portion of the second deasphalter resin, the method further comprising air blowing the asphalt fraction.

11. The method of claim 1, wherein the asphalt fraction is incorporated into the asphalt product without exposing the asphalt fraction to thermal cracking conditions.

12. The method of claim 1, wherein the first solvent deasphalting conditions produce a yield of first deasphalted oil of 50 wt % or less of the feedstock.

13. The method of claim 1, wherein the second solvent deasphalting conditions comprises a $C_5$, $C_6$, or $C_7$ solvent.

14. A method for processing a heavy oil fraction, comprising:

separating a vacuum gas oil fraction and a vacuum resid fraction from a heavy oil feedstock;

performing solvent deasphalting using a $C_3$ or $C_4$ solvent under first solvent deasphalting conditions on at least a portion of the vacuum resid fraction to produce a first deasphalted oil and a first deasphalter residue, the first solvent deasphalting conditions producing a yield of first deasphalted oil of 50 wt % or less of the feedstock;

performing solvent deasphalting using a $C_5$, $C_6$, or $C_7$ solvent on at least a portion of the first deasphalter residue under second solvent deasphalting conditions to form a second deasphalter residue and a second deasphalter resin, the second solvent deasphalting conditions comprising a lower severity than the first solvent deasphalting conditions;

forming a product slate from at least a portion of a) the vacuum gas oil fraction, b) the second deasphalter residue, c) the first deasphalted oil, and d) the second deasphalter resin, the product slate comprising an asphalt fraction and one or more fuels feeds, lubricant feeds, or a combination thereof, a volume of the product slate comprising 95 vol % or more of a combined volume of the vacuum gas oil fraction and the vacuum resid fraction;

performing further processing on the one or more fuels feeds, lubricant feeds, or a combination thereof, the further processing comprising hydroprocessing, fluid catalytic cracking, or a combination thereof; and incorporating the asphalt fraction into an asphalt product.

15. The method of claim 14, wherein the volume of the product slate comprises 105 vol % or less of the combined volume of the vacuum gas oil fraction and the vacuum resid fraction.

16. The method of claim 14, wherein the product slate further comprises a fuel oil fraction.

17. The method of claim 14, wherein the product slate comprises products formed from at least a portion of the first deasphalter residue, at least a portion of the vacuum resid fraction, or a combination thereof.

18. The method of claim 14, wherein the second solvent deasphalting conditions comprise a lower temperature than then first solvent deasphalting conditions; or a combination thereof.

19. The method of claim 14, wherein the one or more fuels feeds, lubricant feeds, or a combination thereof comprise a Conradson Carbon content of 10 wt % or less.

20. The method of claim 14, wherein the one or more fuels feeds, lubricant feeds, or a combination thereof comprise an API Gravity of 14 or more.

21. The method of claim 14, wherein the asphalt fraction is incorporated into the asphalt product without exposing the asphalt fraction to thermal cracking conditions.

22. An asphalt composition, comprising:

an air blown asphalt fraction comprising a deasphalter resin having a kinematic viscosity at 100° C. of 5000 cSt or more.

* * * * *